US005474515A

United States Patent [19]

Epper et al.

[11] Patent Number: 5,474,515

[45] Date of Patent: Dec. 12, 1995

[54] METHOD OF DISCHARGING LIGHT-WEIGHT SUBSTANCES BY ABRUPT CHANGE OF ROTATIONAL SPEED OF A SCREW CONVEYOR CENTRIFUGE COMPONENT

[75] Inventors: Wolfgang Epper, Cologne; Reinhold Schilp, Worthsee, both of Germany

[73] Assignee: Klockner-Humboldt-Deutz AG, Koln-Porz, Germany

[21] Appl. No.: 267,561

[22] Filed: Jun. 28, 1994

[30] Foreign Application Priority Data

Jul. 1, 1993 [DE] Germany ..... 43 21 964.0

[51] Int. Cl.[6] ..... B04B 1/20

[52] U.S. Cl. ..... 494/9; 494/37; 494/53

[58] Field of Search ..... 494/1, 7, 8, 9, 494/10, 37, 52, 53, 54, 84, 85; 210/380.1, 380.3, 781, 787

[56] References Cited

U.S. PATENT DOCUMENTS 3,494,542 2/1970 Craig et al. ..... 494/7

5,176,616 1/1993 Schlip et al. ..... 494/37

FOREIGN PATENT DOCUMENTS 582001 11/1977 U.S.S.R. ..... 494/7

*Primary Examiner*—Charles E. Cooley

*Attorney, Agent, or Firm*—Hardaway Law Firm

[57] ABSTRACT

When a screw-conveyor centrifuge is turned off and its rotation speed diminishes to the point where the centrifugal force is smaller than the force of gravitation, the liquid ring formed inside the centrifuge bowl under the centrifugal force collapses, and a detrimental discharge of liquid takes place at the solids discharge of the centrifuge. In accordance with the method of this invention, the rotation speed of the centrifuge bowl (2) and/or of the screw conveyor (4) is briefly abruptly changed immediately before this critical rotation speed is reached, so that the liquid ring is caused to spiral toward the liquid discharge openings (5) at the other end of the centrifuge (1) by the screw helices (3) of the screw conveyor (4).

7 Claims, 1 Drawing Sheet

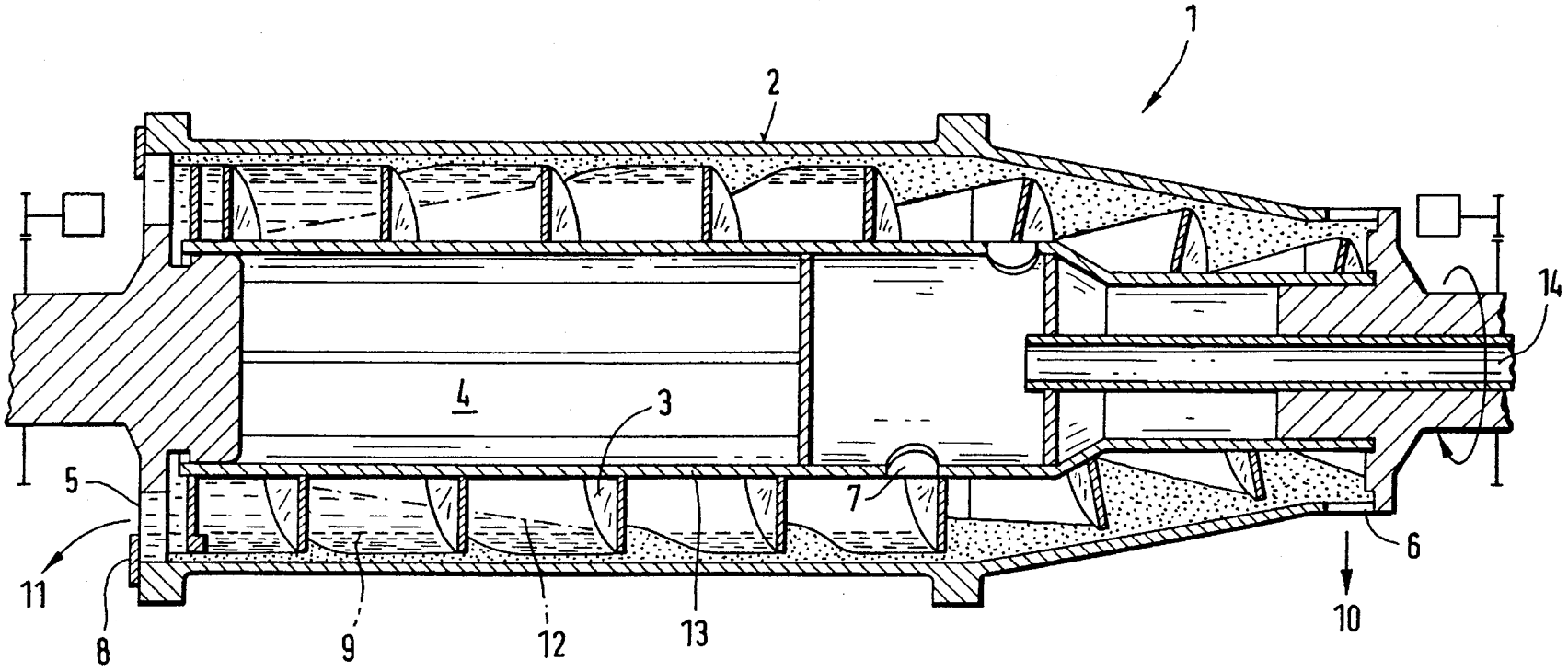
14
6
10
1
7
2
13
3
12
4
9
8
5
11

METHOD OF DISCHARGING LIGHT-WEIGHT SUBSTANCES BY ABRUPT CHANGE OF ROTATIONAL SPEED OF A SCREW CONVEYOR CENTRIFUGE COMPONENT

TECHNICAL FIELD

This invention relates to a method for the operation of screw-conveyor centrifuges for the separation of liquid-solid mixtures.

BACKGROUND OF THE INVENTION

Screw-conveyor centrifuges consist of a centrifuge bowl that is supported rotatably about its longitudinal axis and that encloses a coaxially arranged screw conveyor turning at an unequal rotation speed (leading or lagging). Screw helices are attached to a screw barrel and means are provided for feeding the mixture for separation into the centrifuge bowl along the axis of the centrifuge bowl. Openings are provided at opposite ends of the centrifuge bowl for the discharge of the separated light and heavy substances. The radial distance from the centrifuge bowl shaft axis to said openings is less than the distance from the centrifuge bowl shaft axis to the centrifuge bowl wall, so that during the operation of the screw-conveyor centrifuge a liquid ring forms inside the centrifuge bowl under the action of centrifugal force.

In the separation of liquid-solid mixtures in screw-conveyor centrifuges, under the action of the centrifugal force generated by the rotation of the screw-conveyor centrifuge, the centrifugal force is a multiple of the force of gravitation, and there is formed inside the centrifuge bowl a ring of the liquid-solid mixture being separated. This ring consists primarily of already separated liquid, the inside diameter of which is determined by the radial arrangement of the discharge openings for the light substances (the separated liquid).

The separation into substances of greater and of lesser specific gravity takes place in this liquid ring under the action of the centrifugal force, the substances of greater specific gravity (the solids) arranging themselves at the outer margin of the ring, thus at the centrifuge bowl wall, and the substances of lesser specific gravity (the liquid) disposing themselves layerwise thereover in the inner portion of the ring. By the screw helices of the screw conveyor, which, depending on the rotation direction of the centrifuge, are set in rotation in the same rotation direction, leading or lagging relative to the rotation speed of the centrifuge bowl, the heavy substances are picked up and transported to one end of the centrifuge where they exit the centrifuge through appropriate openings. The light substances flow to the opposite end of the centrifuge, to the discharge openings arranged there, flowing at least partially oppositely to the conveyance direction of the screw conveyor by means of channels formed from the screw helices of the screw conveyor.

When the centrifuge is turned off, the rotation speed of the centrifuge diminishes to a stop and the centrifugal force also diminishes therewith. In this process, a rotation speed is reached at which the centrifugal force becomes less than the force of gravitation, with the consequence that the liquid ring formed in the centrifuge "collapses" and the level inside the centrifuge reaches over the discharge openings for the heavy substances (solids), so that the light substances also exit surgewise at these openings, even if only for a brief time. By this means, not only is the separation result degraded, but also process disturbances are to be anticipated in the further processing of the heavy substances.

OBJECTS AND SUMMARY OF THE INVENTION

It is the object of the invention to create a method for the operation of screw-conveyor centrifuges such that the centrifuges can be turned off while the above-described disadvantages are avoided.

The conveying action of screw conveyors is based on a difference in rotation speed between the screw conveyor and the material to be conveyed, the direction of conveyance being determined by means of the rotation direction and by means of the sense of the helical configuration of the screw conveyor.

In the operation of screw-conveyor centrifuges having a leading screw conveyor, the rotation speed of the screw conveyor is greater than the rotation speed of the material to be conveyed, and the heavy substances, which are turning with the centrifuge bowl, are conveyed by the screw conveyor to one end of the centrifuge in accordance with the sense of the helical configuration.

When operation of the centrifuge is being stopped, and the rotation speed of the centrifuge bowl has diminished to the extent that the collapse of the liquid ring is immediately imminent; in accordance with the invention, the rotation speed of the centrifuge bowl and/or of the screw conveyor is abruptly changed by means of braking, that is, the centrifuge is brought to a stop as quickly as possible, and the following process occurs inside the centrifuge:

The liquid ring turning with the centrifuge bowl, as a consequence of its inertia, initially maintains its velocity, but is now rotating faster than the braked screw conveyor, by which means the conveyance direction is reversed to the direction toward the other end of the centrifuge.

When the liquid ring now collapses, the liquid "spirals" to the end of the centrifuge at which the discharge openings for the light substances are arranged, and no liquid exits at the discharge openings for the heavy substances.

In the operation of the screw-conveyor centrifuge having a lagging screw conveyor, the rotation speed of the screw conveyor is lower than the rotation speed of the centrifuge bowl (the rotation direction of centrifuge bowl and screw conveyor or the sense of the helical configuration of the screw conveyor are reversed relative to the screw-conveyor centrifuge with leading screw conveyor), so that here too, transport occurs in the direction toward the discharge openings for the heavy substances.

When the centrifuge is turned off, in order to reverse the transport direction of the screw conveyor in such a fashion that here too no discharge from the discharge openings for the heavy substances takes place upon the collapse of the liquid ring, it is now necessary that the liquid ring turn more slowly than the screw conveyor. In accordance with the invention, this is achieved by means of the fact that the rotation speed of the centrifuge bowl and/or of the screw conveyor is briefly increased, once again abruptly, by which means, here too, the collapsing liquid ring now "spirals" toward the discharge openings for the light substances, since the liquid ring initially maintains its slow speed on the basis of its inertia.

BRIEF DESCRIPTION OF THE DRAWINGS

Further details and features of the invention are illustrated in the drawing containing a single figure of an exemplary embodiment.

DETAILED DESCRIPTION OF THE DRAWINGS

The drawing shows a solid-bowl screw-conveyor centrifuge (1) of the countercurrent design, with a leading screw conveyor (4). The liquid-solid mixture to be separated is introduced along the rotation axis into the screw-conveyor centrifuge (1) by means of a feed device (14) and passes through openings (7) into the separation space formed by a centrifuge bowl (2) and a screw barrel (13). On the basis of the centrifugal force acting on the introduced mixture and the separation taking place, a liquid ring forms, whose outside diameter corresponds to the inside diameter of the annular wall of the centrifuge bowl (2) and whose inside diameter is given by the position of a weir (8) of a discharge opening (5) for the liquid substances (liquid) and corresponds to a dashed line (9) in the Drawing.

When, in accordance with the invention, the rotation speed is abruptly changed by means of braking of the centrifuge bowl (2) and/or of the screw conveyor (4), which change in rotation speed the liquid ring initially does not follow as a consequence of its inertia, the liquid ring, because its rotation speed is now faster relative to the screw conveyor (4), "spirals" opposite the solids conveyance direction (to the right in the Drawing) in the direction toward the discharge openings (5) for the light substances (to the left in the Drawing).

Because, on account of the limited capacity of the discharge openings (5) for the light substances (11) to be discharged, not all liquid can be discharged immediately, a new liquid ring is formed initially (until the major part of the liquid is discharged), said new ring having an inner surface (12) that is forced toward the left end wall of the centrifuge bowl (2) and thus draws back from discharge openings (6) for heavy substances (10).

By use of this method of operation, the discharge of liquid at the discharge opening (6) for the heavy substances (10) when the liquid ring collapses is successfully prevented.

The invention is not restricted to the exemplary embodiment of a countercurrent screw-conveyor centrifuge illustrated in the Drawing, but is also applicable to other screw-conveyor centrifuges, such as cocurrent screw-conveyor centrifuges, screen-bowl screw-conveyor centrifuges, and the like, whose screw conveyors are driven with the leading or lagging rotation speed.

In operation of a screw-conveyor centrifuge having a lagging screw conveyor, the rotational speed of the screw conveyor is lower than the rotational speed of the centrifuge bowl. Also the pitch of the screw conveyor is the reverse of that for the leading screw conveyor. During normal operation, the heavier material (solids) bearing on the inside of the centrifuge bowl rotates with the bowl faster than the screw conveyor is rotating and thus as it contacts the helices (3) of the screw conveyor, the heavier material is moved toward the discharge openings (6) for heavy substances. When the operation of the lagging screw conveyor centrifuge is being stopped, and the rotational speed of the centrifuge bowl is diminished to near the speed at which the liquid ring collapses, the rotational speed of the centrifuge bowl and/or screw conveyor is briefly and abruptly increased to cause the liquid to be conveyed toward the discharge openings (5) for light substances, thus preventing discharge of liquid from the discharge openings (6) for heavy substances.

That which is claimed:

1. A method of operating a screw conveyor centrifuge for the separation of a liquid-solid mixture into light and heavy substances which includes a centrifuge bowl structure rotatably supported about its longitudinal axis and including an annular wall, a screw conveyor structure coaxially disposed within the centrifuge bowl structure, drive means causing relative rotation between said screw conveyor structure and said centrifuge bowl structure, said screw conveyor structure including a screw barrel to which screw helices are attached, means for feeding the mixture for separation into the centrifuge bowl structure along the longitudinal axis of the centrifuge bowl structure, and openings (5,6) at opposite ends of the centrifuge bowl structure for the discharge of the separated light and heavy substances, respectively, the radial distance from said longitudinal axis to said openings being less than the radial distance from said longitudinal axis to said annular wall, so that during the operation of said screw-conveyor centrifuge a liquid ring forms inside said centrifuge bowl structure under the action of centrifugal force, said method comprising the steps of:

operating said drive means to cause rotation of said structures at unequal speeds while feeding said liquid-solid mixture into said centrifuge bowl structure, turning off said drive means causing the rotational speeds of said structures to decrease; and briefly abruptly changing the rotational speed of at least one of said structures immediately before said centrifuge bowl structure reaches the rotational speed at which the centrifugal force acting on said liquid ring corresponds to the force of gravitation, at which speed a collapse of said liquid ring would take place, said briefly abruptly changing the rotational speed causing said liquid ring, which due to its inertia does not follow the abrupt change in rotational speed, to be transported with the aid of said screw helices (3) to said discharge opening (5) for said separated light substances (11).

2. The method of claim 1, wherein said screw conveyor structure is a leading screw conveyor structure (4) and said briefly abruptly changing the rotational speed is caused by means of a braking operation of at least said screw conveyor structure (4).

3. The method of claim 1 wherein said screw conveyor structure is a lagging screw conveyor structure (4) and said briefly abruptly changing the rotational speed is caused by means of an acceleration of at least said screw conveyor structure (4).

4. The method of claim 1, wherein said at least one of said structures is said centrifuge bowl structure.

5. A method of operating a screw conveyor centrifuge for the separation of a liquid-solid mixture into light and heavy substances which includes a centrifuge bowl rotatably supported about longitudinal axis and including an annular wall, a screw conveyor coaxially disposed within said centrifuge bowl and rotatable relative thereto by drive means rotating said centrifuge bowl and said screw conveyor, said screw conveyor including a screw barrel to which screw helices are attached, means for feeding said mixture for separation into said centrifuge bowl along said longitudinal axis of said centrifuge bowl, and openings (5,6) at opposite ends of said centrifuge bowl for the discharge of said separated light and heavy substances, respectively, the radial distance from said longitudinal axis to said openings being less than the radial distance from said longitudinal axis to said annular wall, so that during the operation of said screw-conveyor centrifuge a liquid ring forms inside said centrifuge bowl under the action of centrifugal force, said method comprising the steps of:

operating said drive means to effect rotation of said centrifuge bowl relative to said screw conveyor while feeding said liquid-solid mixture into said centrifuge bowl, turning off said drive means causing said centrifuge bowl to decrease its rotational speed; and briefly abruptly changing the rotational speed of said screw conveyor (4) immediately before the reaching of a centrifuge bowl rotational speed at which the centrifugal force acting on said liquid ring corresponds to the force of gravitation, at which speed a collapse of said liquid ring would take place, said briefly abruptly changing the rotational speed causing said liquid ring, which due to its inertia does not follow said abrupt change in rotational speed, to be transported with the aid of said screw helices (3) to said discharge opening (5) for said separated light substances (11).

6. The method of claim 5 wherein said screw conveyor is a leading screw conveyor (4) and said briefly abruptly changing the rotational speed is caused by rapidly decreasing the rotational speed of said leading screw conveyor (4).

7. The method of claim 5, wherein said screw conveyor is a lagging screw conveyor and said briefly abruptly changing the rotational speed is caused by rapidly decreasing the rotational speed of said lagging screw conveyor (4).

* * * * *